US006448942B2

(12) United States Patent
Weinberger et al.

(10) Patent No.: US 6,448,942 B2
(45) Date of Patent: Sep. 10, 2002

(54) TUNABLE ANTENNA HAVING SEPARATE RADIATOR PARTS AND PROCESS FOR MANUFACTURING IT

(75) Inventors: Martin Weinberger, München; Michael Schreiber, Feldkirchen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/748,322

(22) Filed: Dec. 26, 2000

Related U.S. Application Data

(63) Continuation of application No. PCT/DE99/00007, filed on Jan. 4, 1999.

(30) Foreign Application Priority Data

Jun. 25, 1998 (DE) ..... 198 28 397

(51) Int. Cl.[7] ..... H01Q 1/36
(52) U.S. Cl. ..... 343/895; 343/745
(58) Field of Search ..... 343/745, 747, 343/748, 750, 895; H01Q 1/36

(56) References Cited

U.S. PATENT DOCUMENTS

| | | | | |
|---|---|---|---|---|
| 2,894,260 A | | 7/1959 | Ellis | 343/745 |
| 3,623,113 A | * | 11/1971 | Faigen | 343/747 |
| 4,148,030 A | * | 4/1979 | Foldes | 343/895 |
| 4,224,625 A | * | 9/1980 | Peretz et al. | 343/750 |
| 4,280,129 A | | 7/1981 | Wells | 343/895 |
| 4,725,395 A | | 2/1988 | Gasparaitis | 343/895 |
| 5,146,235 A | * | 9/1992 | Frese | 343/895 |
| 5,274,393 A | * | 12/1993 | Scott | 343/895 |
| 5,280,645 A | | 1/1994 | Nguyen et al. | 343/745 |
| 5,345,248 A | * | 9/1994 | Hwang et al. | 343/895 |
| 5,349,362 A | * | 9/1994 | Forbes et al. | 343/720 |
| 5,621,322 A | * | 4/1997 | Ehnholm | 324/318 |

FOREIGN PATENT DOCUMENTS

EP 0 889 541 A1 1/1999

OTHER PUBLICATIONS

Published International Application No. WO 98/30038 (Karabinis et al.), dated Jul. 9, 1998.

* cited by examiner

*Primary Examiner*—Tho Phan
(74) *Attorney, Agent, or Firm*—Laurence A. Greenberg; Werner H. Stemer; Ralph E. Locher

(57) ABSTRACT

A tunable antenna includes separate radiator parts coupled to one another. The coupling between the parts is changed by rotating and/or displacing the parts with respect to one another such that the antenna exhibits a radiation pattern associated with a respective degree of a rotation and/or displacement. A process for manufacturing such antennas includes constructing parts for a respective antenna, coupling the parts to one another to permit them to rotate and/or displace, measuring the radiation pattern of the parts, and adjusting the radiation pattern by rotating and/or displacing the parts with respect to one another to set a nominal radiation pattern of the respective antenna formed by the parts. The couple is changed by rotation and/or displacement of the parts. A respective degree of rotation and/or displacement creates a corresponding change of a radiation pattern of the parts.

32 Claims, 5 Drawing Sheets

TUNABLE ANTENNA HAVING SEPARATE RADIATOR PARTS AND PROCESS FOR MANUFACTURING IT

CROSS-REFERENCE TO RELATED APPLICATION

This application is a continuation of copending International Application No. PCT/DE99/00007, filed Jan. 4, 1999, which designated the United States.

BACKGROUND OF THE INVENTION

Field of the Invention

The present invention relates to a tunable antenna having separate radiator parts for tuning to a desired radiation pattern and to a process for manufacturing the antenna.

In the prior art, the molded interconnect device ("MID") technology discloses, among other things, that it is possible to manufacture inexpensive antennas for, i.e., mobile telephones or the like. More precisely, a structure capable of radiating or conducting such as, for example, a helix is galvanically applied to a carrier that is generally round.

Antennas manufactured in such a way are generally narrow-band antennas. Accordingly, it is necessary to tune these antennas to a desired resonant frequency. Such tuning or readjustment has previously been achieved by determining the radiator length of the antenna.

During manufacture of the above-mentioned antennas, however, unavoidable, slight variations in tolerance are obtained. As a result of the variations in tolerance, the respective resonant frequencies of the individual antennas are not at a stable value but change in accordance with the systematic variations in tolerance existing in the antennas during the manufacture of these antennas. The consequence is that the resonant frequencies of the various antennas manufactured by the same process change towards higher or lower values during the manufacturing process. The effect has a permanent negative effect on the quality of the various antennas.

In prior art manufacturing processes, the only possibility for compensating for such variations in tolerance lies in readjusting the antennas by changing the length of the radiators; meaning that it is necessary to make changes in or on the tool used itself. However, such changes are extremely complex and very expensive. A further decisive disadvantage of the prior art manufacturing processes also exists in that such changes in or on the tool can always only be carried out for large numbers but not for relatively small numbers or even individual antennas. As a result, it is not possible to compensate for short-term variations in tolerance occurring generally.

SUMMARY OF THE INVENTION

It is accordingly an object of the invention to provide a tunable antenna having separate radiator parts for tuning to a desired radiation pattern and a process for manufacturing the antenna that overcomes the hereinafore-mentioned disadvantages of the heretofore-known devices and methods of this general type and that can be tuned to a desired radiation pattern with little manufacturing expenditure With the foregoing and other objects in view, there is provided, in accordance with the invention, a tunable antenna, including at least first and second separate radiator parts having a couple therebetween and defining a radiation pattern, the couple formed to be changed by at least one of rotation and displacement of the at least first and second radiator parts with respect to one another where a respective degree of at least one of rotation and displacement creates a corresponding change the radiation pattern.

According to the invention, a tunable antenna is created that has at least first and second separately constructed radiator parts that are coupled to one another. Coupling between the radiator parts can be changed by rotating and/or displacing the radiator parts with respect to one another such that the antenna exhibits a radiation pattern associated with a respective degree of a rotation and/or displacement.

Accordingly, the antenna of the invention achieves an essential advantage that the antenna can be changed in a simple manner in its effective radiator length by a rotation and/or displacement of the radiator parts. Because the radiation pattern of the antenna is a function of the effective radiator length, the radiation pattern of the antenna can also be changed in a simple manner by rotating and/or displacing the radiator parts with respect to one another. The resonant frequency or, respectively, the resonant frequencies of the antenna represent a measure of the effective radiator length and can be used for assessing the radiation pattern.

The coupling between the radiator parts can be an electrical coupling, a capacitive coupling, and/or an inductive coupling.

In accordance with another feature of the invention, there is provided a cap for covering the separate radiator parts.

In accordance with a further feature of the invention, the first radiator part has a first helix and a conductor part. The first helix has an end, a first longitudinal center axis and extends parallel or inclined to the first longitudinal center axis. The conductor part is disposed at the end. The second radiator part has a second helix and an open turn. The second helix has an end and a second longitudinal center axis. The open turn is disposed at the end and is disposed in a plane extending one of perpendicularly and inclined to the second longitudinal center axis of the helix.

In accordance with an added feature of the invention, the radiator parts are disposed with respect to one another to align the longitudinal center axes of the helices and such that the conductor part electrically contacts the open turn. At least one of the radiator parts is formed to rotate about a respective longitudinal center axis of the helix.

In accordance with an additional feature of the invention, the radiator parts are a plurality of first and second radiator parts disposed in an alternating sequence.

In accordance with yet another feature of the invention, there is provided a third radiator part having a rod, a conductor part, and an open turn. The rod has a longitudinal center axis and first and second ends. The conductor part is disposed at the first end and has a longitudinal center axis aligned with the longitudinal center axis of the rod. The open turn is disposed at the second end and is located in a plane extending perpendicular or inclined to the longitudinal center axis of the rod.

In accordance with yet a further feature of the invention, the radiator parts are disposed with respect to one another such that the longitudinal center axes of the helices of first and second radiator parts are aligned. The longitudinal center axes of the rod and of the conductor part of a third radiator part extend one of parallel and inclined to the longitudinal center axes of the helices of the first and second radiator parts. The conductor part of the first radiator part electrically contacts the open turn of the third radiator part. The conductor part of the third radiator part electrically contacts the open turn of the second radiator part. At least one of the radiator parts is formed to be rotated about the longitudinal center axes of the helices of the first and second radiator parts.

In accordance with yet an added feature of the invention, the radiator parts are a plurality of first, second, and third radiator parts disposed such that respective longitudinal center axes of the helices of the first and second radiator parts are aligned. The respective longitudinal center axes of the rod and of the conductor part of the third radiator part extend parallel and/or inclined to the longitudinal center axes of the helices of the first and second radiator parts. A conductor part of one of the radiator parts electrically contacts an open turn of an adjoining conductor part of one of the radiator parts. At least one of the radiator parts is formed to be rotated about the longitudinal center axes of the helices of the radiator parts.

In accordance with yet an additional feature of the invention, the first radiator part has a first helix and a first plate part. The first helix has an end and a first longitudinal center axis. The plate part is disposed at the end and is disposed in a plane extending perpendicular and/or inclined to the longitudinal center axis of the first helix. The second radiator part has a second helix and a second plate part. The second helix has an end and a second longitudinal center axis. The plate part is disposed at the end of the second helix and is disposed in a plane extending perpendicular and/or inclined to the second longitudinal center axis.

In accordance with again another feature of the invention, the radiator parts are disposed with respect to one another such that the longitudinal center axes are aligned and the first plate part is opposite the second plate part at a predetermined distance. At least one of the radiator parts is formed to be rotated about the longitudinal center axes such that an area of coverage of the plate parts is changed with a respective degree of rotation.

In accordance with again a further feature of the invention, the plate parts are disc segments.

In accordance with again an added feature of the invention, the first radiator part has a first helix. The first helix has a first longitudinal center axis. The second radiator part has a second helix; the second helix has a second longitudinal center axis. The radiator parts are disposed with respect to one another such that the longitudinal center axes are aligned. The radiator parts overlap one another in a direction of the first and second longitudinal center axes and/or are opposite one another at a predetermined distance. At least one of the radiator parts is formed to be displaced along the longitudinal center axes such that an overlap area and/or the distance between the radiator parts is changed with a degree of displacement.

In accordance with again an additional feature of the invention, the first radiator part has a first helix and a first meander-shaped part. The first helix has a first longitudinal center axis. The second radiator part has a second helix and a second meander-shaped part. The second helix has a second longitudinal center axis. The radiator parts are disposed with respect to one another such that the longitudinal center axes are aligned and the first meander-shaped part contacts the second meander-shaped part. At least one of the radiator parts is formed to be rotated about the longitudinal center axes such that an inductance formed by the meander-shaped parts is changed with a degree of rotation.

In accordance with still another feature of the invention, at least one of the first and second meander-shaped parts is a radiating part.

In accordance with still a further feature of the invention, at least first and second radiator parts are applied to respective carriers, and the respective carriers are round and/or angular.

In accordance with still an added feature of the invention, the radiator parts are manufactured in MID technology.

In accordance with still an additional feature of the invention, the radiator parts are fixed with respect to one another after being set to a desired radiation pattern.

In accordance with a further feature of the invention, the helices have identical and/or different pitches, identical and/or different diameters, and equal and/or oppositely directed pitches.

With the objects of the invention in view, there is also provided a process for manufacturing tunable antennas, including the steps of constructing radiator parts for a respective antenna, coupling the parts to one another to permit the parts to at least one of rotate and displace with respect to one another, the couple being changed by at least one of rotation and displacement of the parts with respect to one another where a respective degree of at least one of rotation and displacement creates a corresponding change of a radiation pattern of the parts, measuring the radiation pattern of the parts; and adjusting the radiation pattern by at least one of rotating and displacing the parts with respect to one another to set a nominal radiation pattern of the respective antenna formed by the parts.

A process for manufacturing such a tunable antenna exhibits the steps of constructing the radiator parts for a respective antenna and disposing the radiator parts such that they are coupled to one another and can be rotated and/or displaced with respect to one another. For the respective antenna, an actual radiation pattern of the respective antenna is measured, and a radiation pattern of the respective antenna is adjusted by rotating and/or displacing the radiator parts with respect to one another in order to set a nominal radiation pattern of the respective antenna.

Accordingly, the process of the invention provides the possibility of readjusting, for example, the resonant frequencies of the antennas in a simple manner in the current manufacturing process by measuring the resonant frequency of a respective antenna and rotating and/or displacing the two radiator parts with respect to one another.

In particular, the process can be configured such that a first arbitrary number of antennas is manufactured by repeating the first two steps an arbitrary number of times and the actual radiation pattern of one or more of the first arbitrary number of manufactured antennas is measured. A second arbitrary number of antennas is manufactured by repeating the first two steps an arbitrary number of times, and a nominal radiation pattern of the antennas of the second arbitrary number is set based on a value that is derived based upon the measured actual radiation pattern of the one or more antennas of the first arbitrary number.

In accordance with a mode feature of the invention, a cap is placed on the antenna before and/or after adjusting the radiation pattern and/or setting the nominal radiation pattern.

In accordance with a concomitant mode of the invention, the parts of the antennas are mutually fixed before and/or after adjusting the radiation pattern and/or setting the nominal radiation pattern.

The invention provides, in a simple manner, the possibility of adjusting the antennas to a particular radiation pattern in the current manufacturing process.

Other features that are considered as characteristic for the invention are set forth in the appended claims.

Although the invention is illustrated and described herein as embodied in a tunable antenna having separate radiator parts for tuning to a desired radiation pattern and a process for manufacturing the antenna, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
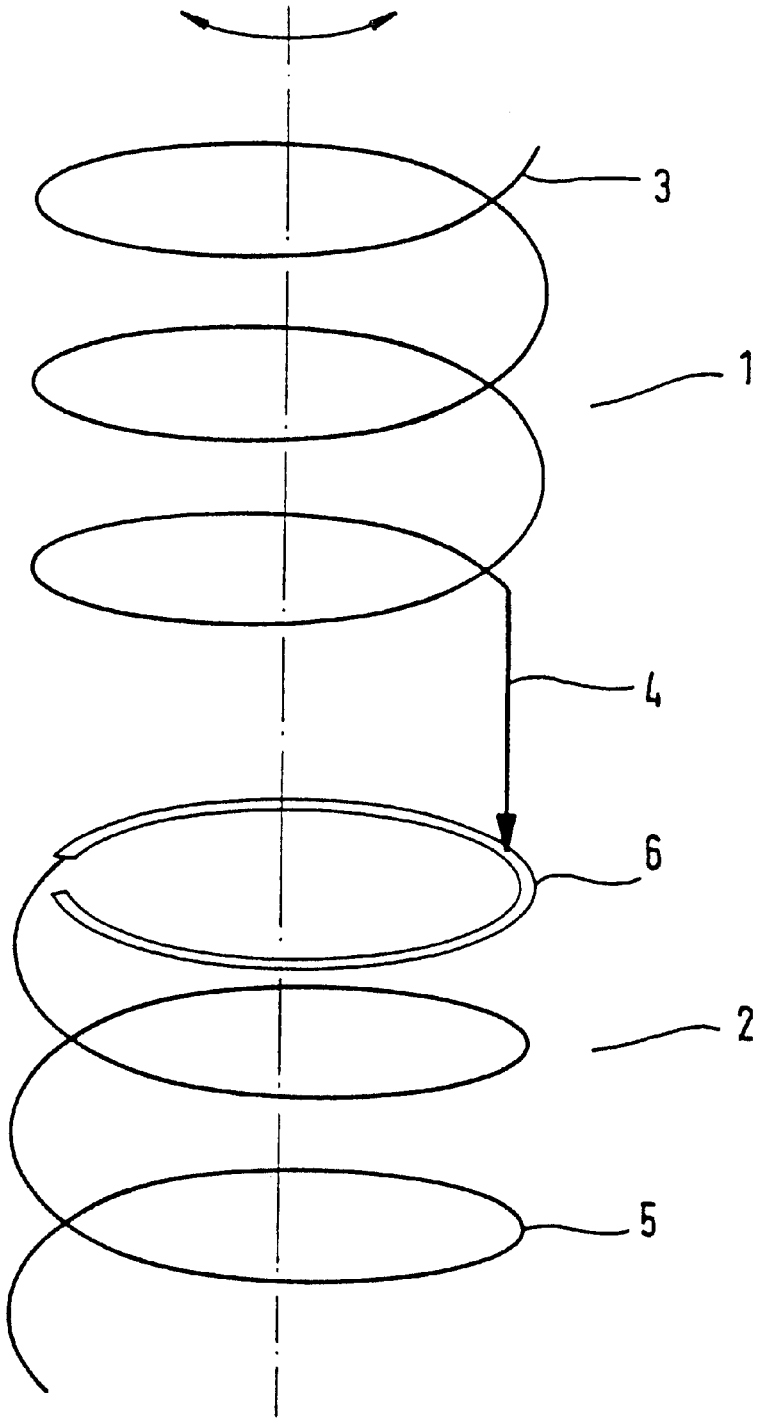
FIG. 1 is a diagrammatic perspective view of a tunable antenna according to a first embodiment of the invention.

In all the figures of the drawing, sub-features and integral parts that correspond to one another bear the same reference symbol in each case.

Referring now to the figures of the drawings in detail and first, particularly to FIG. 1 thereof, there is shown a diagrammatic representation of a tunable antenna according to the first exemplary embodiment of the present invention.

As shown in FIG. 1, a first radiator part 1 has a helix 3 and a conductor part 4. The helix 3 has a longitudinal center axis represented by a dot-dashed line. The conductor part 4 is disposed at one end of the helix 3 such that a non-illustrated longitudinal center axis of the conductor part 4 extends parallel to the longitudinal center axis of the helix 3.

A second radiator part 2 also has a helix 5 and an open turn 6. Helix 5 also has a longitudinal center axis represented by the dot-dashed line. The open turn 6 is disposed at one end of the helix 5 and is located in a plane that extends perpendicularly to the longitudinal center axis of the helix 5 of the second radiator part 2.

In the first exemplary embodiment, the first and second radiator parts 1, 2 are disposed with respect to one another such that the longitudinal center axes of the respective helices 3, 5 of the first and second radiator parts 1, 2 are aligned, that is to say, they are located in one line. The conductor part 4 of the first radiator part 1 electrically contacts the open turn 6 of the second radiator part 2. Furthermore, either the first or the second radiator part 1, 2, respectively, can be rotated about the longitudinal center axes of the helices 3, 5 of the first and second radiator parts 1, 2, or both radiator parts 1, 2 can be rotated about the longitudinal center axes of the helices 3, 5.

In the first embodiment, the two separate radiator parts 1, 2 with the conductor part 4 and the open turn 6 makes it possible to tune the antenna in a simple manner to a desired radiation pattern such as, for example, a resonant frequency. More precisely, the fact that the first and second radiator parts 1, 2 are coupled to one another and can be rotated with respect to one another provides the possibility of changing the resonant frequency of the tunable antenna. For example, following a measurement of the actual resonant frequency of the tunable antenna after its manufacture, the resonant frequency of the tunable antenna can be changed by altering the coupling between the radiator parts 1, 2 through rotation of the part 1, 2 with respect to one another because such a rotation changes the effective radiator length of the radiator parts 1, 2 of the tunable antenna. The resonant frequency of the tunable antenna is a function of the effective radiator length.

As such, the effective radiator length of the radiator parts 1, 2 exhibits a value that is associated with a respective degree of rotation because, due to the rotation, the conductor part 4 that is electrically in contact with the open turn 6 migrates along the open turn 6.

It is noted that the antenna of the first exemplary embodiment of the invention can be made of more than the two radiator parts 1, 2 shown in FIG. 1. For example, such radiator parts 1, 2 can be disposed in an arbitrary number in alternating sequence if the radiator parts 1, 2 that do not represent the outermost radiator parts 1, 2 of the antennas exhibit both a conductor part 4 and an open turn 6.

Furthermore, it is noted that the conductor part 4 can also be disposed such that the longitudinal center axis of the conductor part 4 extends inclined to the longitudinal center axis of the helix 3. Also, the open turn 6 can be disposed in a plane that extends inclined to the longitudinal center axis of the helix 5 as long as the radiation pattern of the antenna can be changed by rotation. For the invention, however, it is not mandatory for the open turn 6 to be located in one plane.

Figure 2:
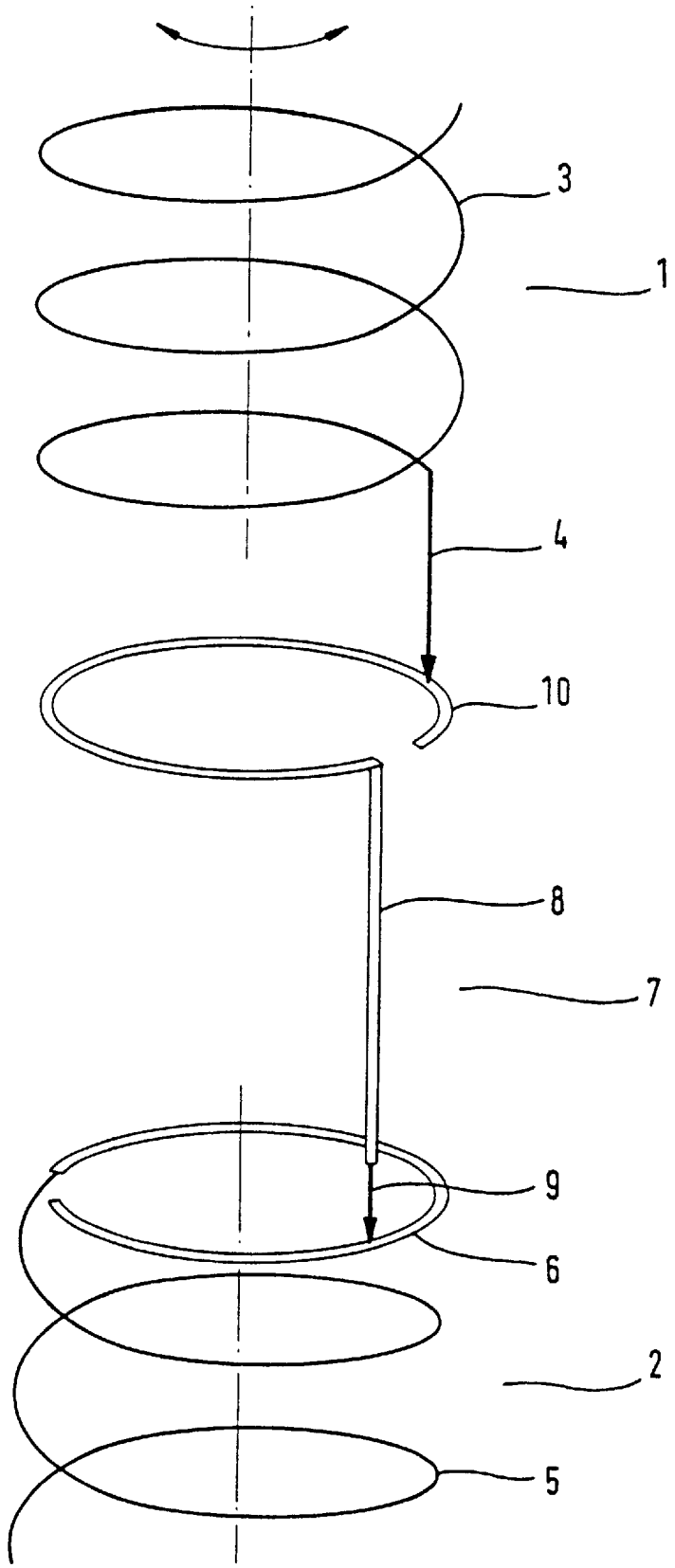
FIG. 2 is a diagrammatic perspective view of a tunable antenna according to another embodiment of the invention.

FIG. 2 illustrates a representation of a tunable antenna according to a second exemplary embodiment of the invention. Apart from the changes described below, the second exemplary embodiment is similar to the first, which has been described above.

In addition to the first and second radiator parts 1, 2 of the first embodiment, the second embodiment has a third radiator part 7 having a structure differing from the first and second radiator parts 1, 2. The third radiator part 7 includes a radiating or non-radiating rod 8, a conductor part 9, and an open turn 10. In the configuration, the conductor part 9 is provided at one end of the rod 8 and the open turn 10 is provided at another end of the rod 8 as shown in FIG. 2. The non-illustrated longitudinal center axis of the conductor part 9 is aligned with the non-illustrated longitudinal center axis of the rod 8, and the open turn 10 is disposed in a plane extending perpendicular to the longitudinal center axis of the rod 8.

In the second embodiment, the third radiator part 7 is disposed between the first radiator part 1 and the second radiator part 2. More precisely, the three radiator parts 1, 2, 7 are disposed such that the longitudinal center axes of the first and second radiator parts 1, 2 are aligned, and the longitudinal center axes of the rod 8 and of the conductor part 9 of the third radiator part 7 extend parallel to the longitudinal center axes of helices 3, 5 of the first and second radiator parts 1, 2. Furthermore, the conductor part 4 of the first radiator part 1 electrically contacts the open turn 10 of the third radiator part 7 and the conductor part 9 of the third radiator part 7 electrically contacts the open turn 6 of the second radiator part 2.

At least one of the radiator parts 1, 2, 7 can be rotated about the longitudinal center axes of the helices 3, 5 of the first and second radiator parts 1, 2 and 7 in order to achieve a tuning of the tunable antenna by the rotation of a respective radiator part or radiator parts 1, 2, 7, as in the first exemplary embodiment. According to the second embodiment, however, there is a two-fold possibility of tuning the tunable antenna. The first possibility is in the rotation of the first and second radiator parts 1, 7 with respect to one another and the second possibility is in the rotation of the third and second radiator parts 7, 2 with respect to one another.

The advantages that have been described above are also achieved in the second embodiment.

It is noted that the antenna of the second embodiment can be made of more than the three radiator parts 1, 2, 7 shown in FIG. 2. For example, such radiator parts 1, 2, 7 can be disposed in an arbitrary number such that the longitudinal center axes of the helices 3, 5 of the first and second radiator parts 1, 2 are aligned, and the longitudinal center axes of the rod 8 and of the conductor part 9 of the third radiator part 7 extend parallel to the longitudinal center axes of the helices 3, 5 of the first and second radiator parts 1, 2. In the configuration, a conductor part of a radiator part electrically contacts an open turn of an adjoining radiator part, and at least one of the radiator parts 1, 2, 7 can be rotated about the longitudinal center axes of the helices 3, 5 of the first and second radiator parts 1, 2.

A further possible embodiment of the tunable antenna is made, for example, in providing a first radiator part that is only formed from a radiating or non-radiating rod and a second radiator part that has a structure identical to the second radiator part 2 in FIG. 2. In such a configuration, too, there exists the possibility of tuning the antenna by rotating it to a desired radiation pattern.

As in the first embodiment, it is not mandatory in the second embodiment, either, for the aforementioned aligned, perpendicular and parallel relations between the individual parts of the tunable antenna to be maintained as long as the radiation pattern of the antenna can be changed by rotation.

Figure 3:
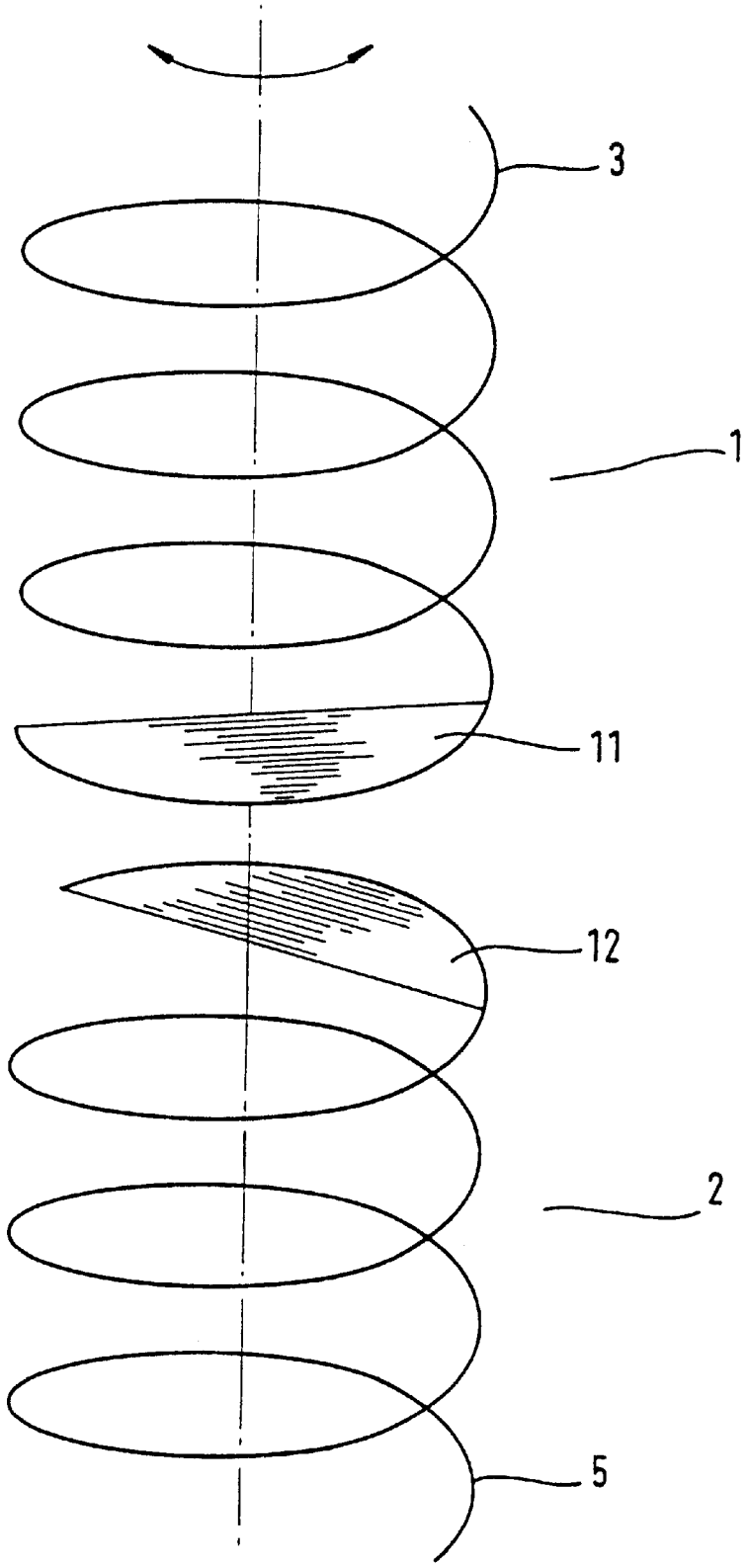
FIG. 3 is a diagrammatic perspective view of a tunable antenna according to another embodiment of the invention.

According to the first and second embodiments of the invention, the respective radiator parts of the tunable antenna are electrically coupled to one another. However, the invention is not restricted to such an electrical coupling. Instead, the respective radiator parts can also be capacitively coupled to one another, as is shown in FIG. 3.

According to the third embodiment, the first radiator part 1 also has a plate part 11 instead of the conductor part 4 shown in FIG. 1 and the second radiator part 2 has, instead of the open turn 6 in FIG. 1, a plate part 12. The plate parts are respectively provided at one end of the helices 3, 5, respectively, of the first and second radiator part 1, 2, respectively.

In the configuration, the plate part 11 is disposed in a plane extending inclined to the longitudinal center axis of the helix 3 of the first radiator part 1. The plate part 12 is located in a plane that extends inclined to the longitudinal center axis of the helix 5 of the second radiator part 2. In the configuration, however, the two plate parts 11, 12 can also extend perpendicularly to the longitudinal center axes.

Furthermore, the first and second radiator parts are disposed similar to the first exemplary embodiment such that the longitudinal center axes of the helices 3, 5 of the first and second radiator parts 1, 2 are aligned. In the configuration, the plate part 11 is opposite the plate part 12 at a predetermined distance, as shown in FIG. 3. Furthermore, at least one of the two radiator parts 1, 2 can be rotated about the longitudinal center axes of the two radiator parts 1, 2 such that an area of coverage of the plate parts 11 and 12 can be changed with the respective degree of a rotation. As such, a capacitive coupling is formed between the first and second radiator parts 1, 2. The capacitance of the coupling between these radiator parts 1, 2 can be changed with the degree of rotation so that the tuning of the tunable antenna to a desired radiation pattern is carried out through the change in capacitance between the two radiator parts 1, 2.

The third embodiment also provides the advantages of the first and second embodiments.

Although FIG. 3 shows that the plate parts 11 and 12 have a shape of a disc segment, the possibility also exists for other shapes as long as the area of coverage of the plate parts 11 and 12 can be changed by rotation.

As in the first and second embodiments, it is not mandatory in the third embodiment, either, for the aforementioned aligned, perpendicular, parallel, and inclined relations between the individual parts of the tunable antenna to be maintained as long as the radiation pattern of the antenna can be changed by rotation.

Figure 4:
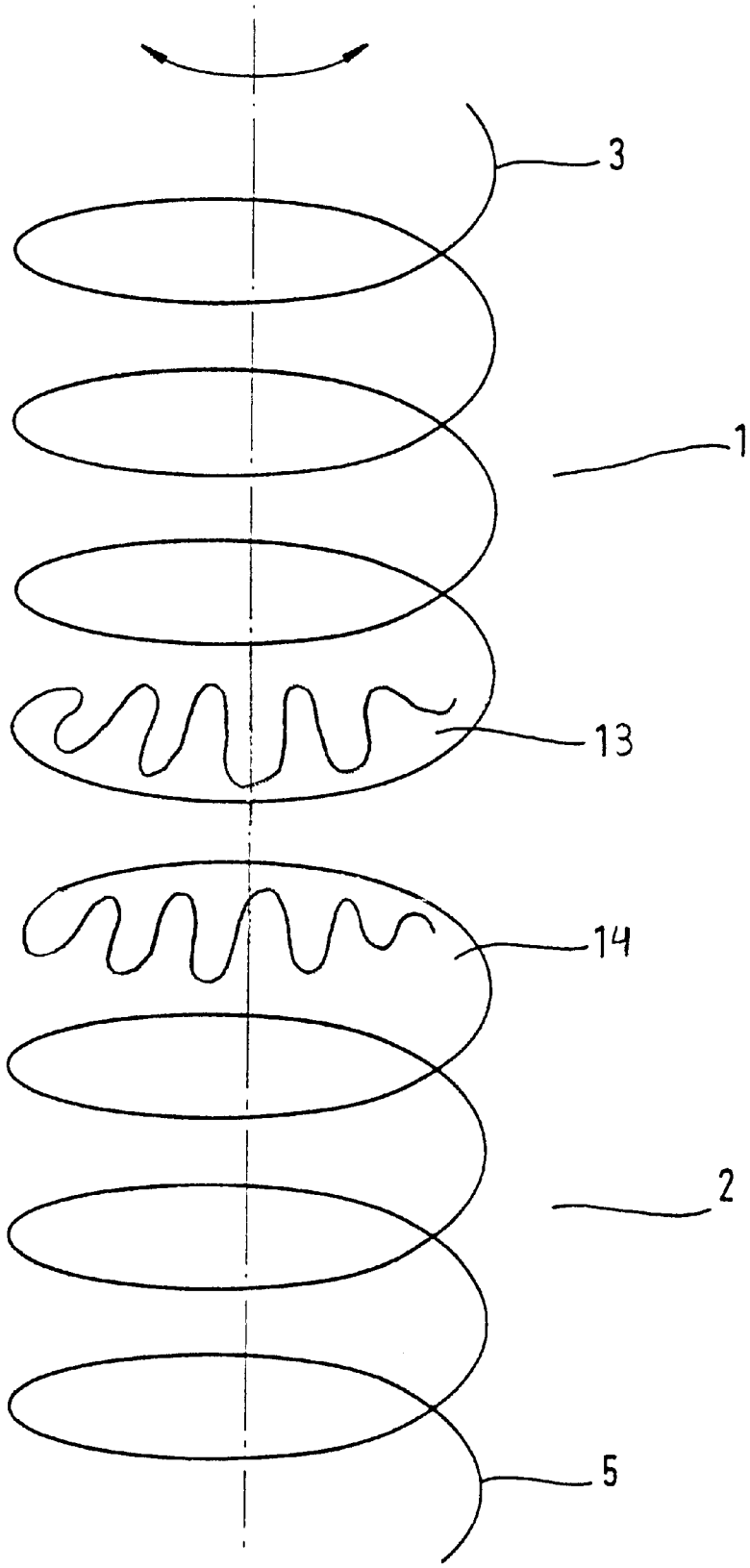
FIG. 4 is a diagrammatic perspective view of a tunable antenna according to another embodiment of the present invention.

According to the first to third embodiments, the respective radiator parts of the tunable antenna are electrically or capacitively coupled to one another. However, the invention is not restricted to such electrical or capacitive coupling. Instead, the respective radiator parts can also be coupled inductively to one another. Such inductive coupling can be achieved, for example, by a first helix and a second helix respectively having a meander-shaped part 13, 14 as shown in FIG. 4. The meander-shaped parts 13, 14 are in contact with one another such that the inductance formed by the two meander-shaped parts 13, 14 together can be changed by a rotation of the parts. Rotation can be performed by measures similar to those described in the first to third embodiments. The respective meander-shaped parts 13, 14 can be radiating parts.

A significant advantage that is achieved in accordance with the first to fourth exemplary embodiments of the invention is that the total length of the antenna in the direction of the longitudinal center axes of the radiator parts 1, 2 is always the same independently of a rotation of the radiator parts 1, 2.

Figure 5:
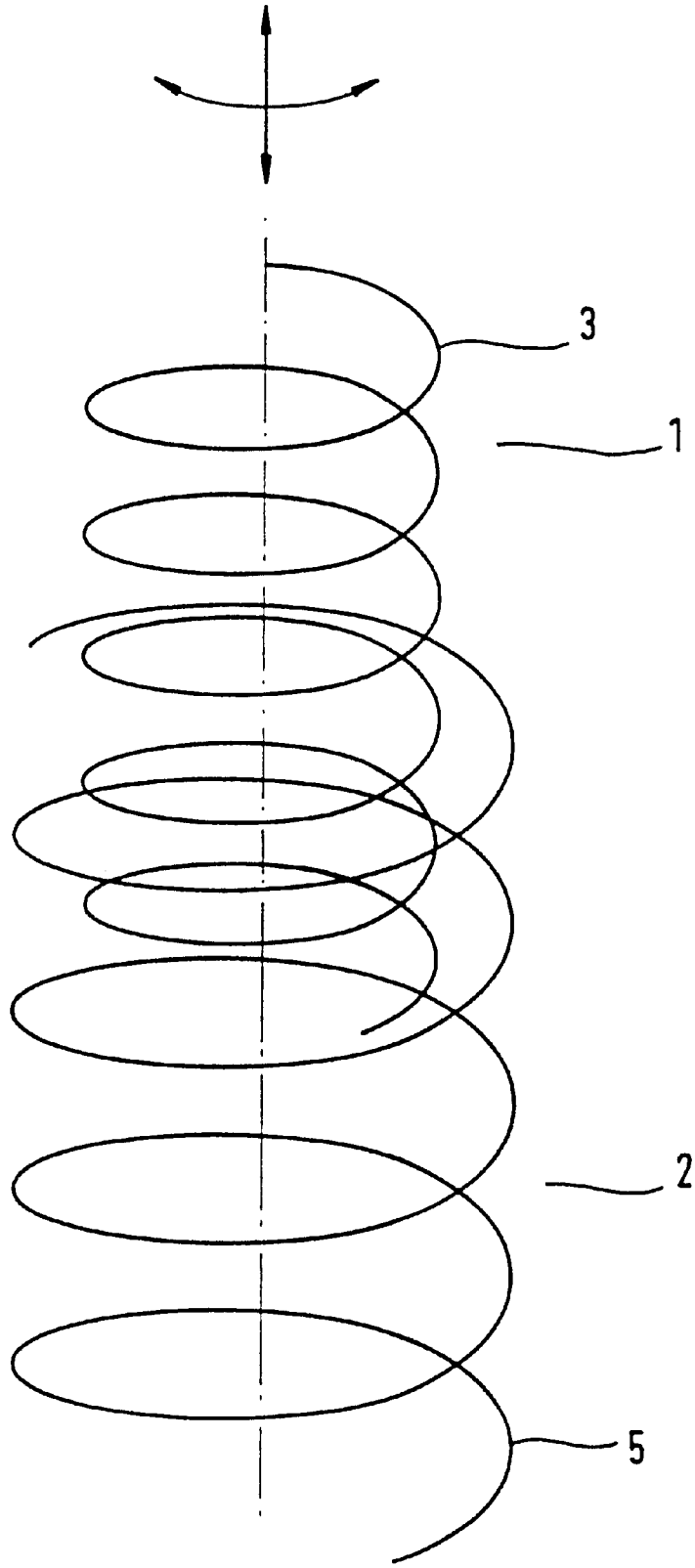
FIG. 5 is a diagrammatic perspective view of a tunable antenna according to another embodiment of the present invention.

FIG. 5 illustrates a tunable antenna according to another embodiment of the invention. As shown in FIG. 5, first and second radiator parts 1, 2 exhibit a first helix 3 and, respectively, a second helix 5. The two radiator parts 1, 2 are disposed with respect to one another such that longitudinal center axes of the helices 3, 5 are aligned and the radiator parts 1, 2 overlap one another in the direction of the longitudinal center axes of the helices 3, 5. More precisely, the first radiator part 1 in the embodiment is disposed such that it is located with a certain length within the second radiator part 2. Accordingly, the outside diameter of the first radiator part 1 is smaller than the inside diameter of the second radiator part 2. Furthermore, at least one of the first and second radiator parts 1, 2 can be rotated about the longitudinal center axes of the helices 3, 5 of the first and second radiator parts 1, 2, or displaced in the direction of these longitudinal center axes, such that the area of overlap of the radiator parts 1, 2 can be changed with the degree of rotation and/or displacement.

Rotation is achieved by the two radiator parts 1, 2 either performing a helical movement with respect to one another or a displacement with respect to one another in the direction of the longitudinal center axes of the helices 3, 5. In other words, according to the embodiment the two radiator parts 1, 2 are not only rotated with respect to one another but, during a rotation of the two radiator parts 1, 2 with respect to one another, there is also a displacement in the direction of the longitudinal center axes of the helices 3, 5 of the two radiator parts 1, 2. Or, the two radiator parts 1, 2 are simply displaced in the direction of the longitudinal center axes of the helices 3, 5. As a result, the coupling between the two radiator parts 1, 2 is changed as a function of the degree of a rotation and/or displacement. Accordingly, a tuning of the radiation pattern of the tunable antenna is achieved by the change in the coupling between the two radiator parts 1, 2.

A further possibility exists in the two radiator parts 1, 2 not overlapping one another but being located opposite one another at a predetermined distance. In such an embodiment, too, a coupling of the two radiator parts 1, 2 can be changed as described above. As a result, the radiation pattern of the antenna can be similarly adjusted.

The advantages engendered in the other embodiments of the invention are also achieved by the embodiment. However, in the embodiment, the total length of the tunable antenna changes when it is being adjusted.

The antennas described above can be configured such that the respective radiator parts are fixed with respect to one another after having been set to a desired radiation pattern.

It is advantageous to construct the tunable antennas by using the molded interconnect device technology. The individual separated radiator parts are constructed on mutually separated carriers, which are preferably round or angular. In such MID antennas, the essential advantage is that they can be set to a desired radiation pattern simply by using the rotation and/or displacement of the carriers on which the radiator parts are constructed without requiring expensive changes in or on the tool.

In the manufacture of such MID antennas, the possibility then exists to adjust these antennas to a desired radiation pattern with little manufacturing expenditure during the current production process of the MID antennas.

In general, such antennas have a cap that covers them. The cap is used as mechanical protection and/or for improving the external appearance of the antenna. In the aforementioned antennas there is also an advantage in that they can be adjusted to a desired radiation pattern during the manufacturing process before and/or after the cap has been placed on. That is to say, if the antennas are adjusted after the cap has been placed on, tolerances of the cap which have an effect on the radiation pattern can be taken into consideration when the antennas are adjusted to a desired radiation pattern.

It is also noted that an arbitrary combination of the aforementioned exemplary embodiments with one another is also possible if the shapes of the individual radiator parts are suitably adapted. If, for example, a radiator part with a helix and a conductor part at one end of the helix is coupled to another radiator part having a helix with an open turn at one end of the helix and a plate part at the other end of the helix, and the further radiator part is coupled to yet another radiator part having a helix with a plate part at one end of the helix, a tunable antenna can be constructed that can be tuned to a desired radiation pattern both by an electrical coupling and a capacitive coupling of the various radiator parts. Similarly, many other combinations of the embodiments with one another are possible.

Furthermore, the shape of the individual components effecting a coupling between the radiator parts such as, for example, the conductor part and the open turn, is not restricted to that previously described with respect to the exemplary embodiments but, instead, components with other shapes can be used as long as they meet the condition that an electrical, capacitive, or inductive coupling between two radiator parts can be changed by a rotation and/or displacement of these radiator parts with respect to one another in order create the possibility of tuning the tunable antenna to a desired radiation pattern in a simple manner.

The individual parts of the respective radiator parts can also be constructed integrally with one another. For example, the conductor part can simply be one end of a helix of the radiator part.

Furthermore, it is noted that the aligned, parallel, and perpendicular relations of the different parts of the tunable antennas according to the exemplary embodiments described above are not mandatory as long as the tunable antennas can be rotated and/or displaced such that the radiation pattern of the antennas can be changed by rotation and/or displacement of the radiator parts of the antennas.

In this context, a displacement of the radiator parts of the antennas with respect to one another can also take place, for example, in a direction extending perpendicularly or inclined to the longitudinal center axes of the helices. Thus, the third embodiment, for example, can be configured such that a displacement in the direction of the longitudinal center axes of the helices 3, 5 and/or a displacement perpendicular to the longitudinal center axes of the helices 3, 5 can be carried out in addition to or instead of the rotation.

Finally, it is noted that the respective helices can exhibit an identical or a different pitch and/or identical or different diameters and/or equal or oppositely directed pitches.

Similarly, parts having different shapes can be used instead of the helices. For example, such parts can be meander-shaped.

A process for manufacturing tunable antennas in the exemplary embodiments described above, in which a tuning of the tunable antennas to a desired radiation pattern can be achieved in a simple manner, will be described in the following text.

In accordance with the process, the respective antennas of any of the exemplary embodiments are first manufactured. More precisely, the respective radiator parts of a respective antenna are constructed and these radiator parts are configured such that they are coupled to one another and can be rotated and/or displaced with respect to one another. In the process, the radiator parts are applied to respective carriers, preferably by the MID technology. Following the manufacturing, the actual radiation pattern of a respective antenna is measured. Finally, the effective radiator length of the radiator parts is set by rotating and/or displacing the radiator parts with respect to one another in order to set a nominal radiation pattern of the respective antenna.

The process is advantageous in that it can be carried out during the manufacturing process of the antennas and, accordingly, a continuous check of the respective antennas takes place. Such continuity significantly improves both the quality of the antennas and the manufacturing yield.

A description of the mass production of the above mentioned tunable antennas follows. According to the process, a first arbitrary number of the tunable antennas according to one of the exemplary embodiments is manufactured. That is to say, the construction of the radiator parts and the configuration of the radiator parts with respect to one another are repeated a first arbitrary number of times. Then, the actual radiation pattern of one or more of the first arbitrary number of manufactured antennas is measured. Next, a second arbitrary number of antennas is manufactured, the nominal radiation pattern of these antennas is set based on a value that is derived from the actual radiation pattern of the one or more antennas of the first arbitrary number.

In the process, the nominal radiation pattern can be set either before or after, or both before and after, a cap has been placed on the antennas so that tolerances caused by the cap and that have an effect on the radiation pattern of the antennas can also be taken into consideration. The feature applies to both manufacturing processes described above.

In a further step, the radiator parts of the antennas can be brought into a mutually fixed relation after the nominal radiation pattern has been set, so that a change in the radiation pattern of the antenna is prevented.

A further essential advantage of the aforementioned processes is that these manufacturing processes can be corrected continuously.

According to the above exemplary embodiments, the dispersion of the resonant frequency between various tunable antennas can be significantly reduced. For example, the quality and yield can be significantly increased.

Finally, it is noted that investigations by the inventors of the invention have led to the following results. An investigation of a tunable antenna according to the first exemplary embodiment of the present invention described above was made. In the investigation, the first radiator part 1 was located on a rotatable Teflon mandrel and the open turn 6 of the second radiator part 2 had a gap of 30°. The configuration resulted in a tunable antenna, having an actual resonant frequency of, for example, 700 MHz, with a maximum possible rotation of 330°, exhibiting a wide tuning range of approximately 20 to 25 MHz.

We claim:

1. A tunable antenna, comprising:

at least first and second separate radiator parts having an electrical coupling therebetween and defining a radiation pattern, said coupling formed to be changed by at least one of rotation and displacement of said at least first and second radiator parts with respect to one another where a respective degree of at least one of rotation and displacement creates a corresponding change said radiation pattern;

said first radiator part having a first helix and a first conductor part, said first helix having an end and a first longitudinal center axis and extending one of parallel and inclined to said first longitudinal center axis, said first conductor part being disposed at said end;

said second radiator part having a second helix and an second open turn, said second helix having an end and a second longitudinal center axis, said second open turn being disposed at said end and being disposed in a plane extending one of perpendicularly and inclined to said second longitudinal center axis of said helix; and a third radiator part having a rod, a third conductor part, and a third open turn, said rod having a longitudinal center axis and first and second ends, said third conductor part being disposed at said first end and having a longitudinal center axis aligned with said longitudinal center axis of said rod, said third open turn being disposed at said second end and being located in a plane extending one of perpendicular and inclined to said longitudinal center axis of said rod.

2. The tunable antenna according to claim 1, including a cap for covering said at least first and second separate radiator parts.

3. The tunable antenna according to claim 1, wherein:

said first and second radiator parts are disposed with respect to one another to align said longitudinal center axes of said helices of said first and second radiator parts and such that said first conductor part electrically contacts said second open turn; and at least one of said first and second radiator parts is formed to rotate about a respective longitudinal center axis of said helix.

4. The tunable antenna according to claim 3, wherein said at least first and second separate radiator parts is a plurality of first and second radiator parts disposed in an alternating sequence.

5. The tunable antenna according to claim 1, wherein said at least first and second separate radiator parts is a plurality of first and second radiator parts disposed in an alternating sequence.

6. The tunable antenna according to claim 1, wherein said first, second, and third radiator parts are disposed with respect to one another such that said longitudinal center axes of said helices of said first and second radiator parts are aligned, said longitudinal center axes of said rod and of said third conductor part extend one of parallel and inclined to said longitudinal center axes of said helices of said first and second radiator parts, said first conductor part electrically contacts said third open turn, said third conductor part electrically contacts said second open turn, and at least one of said first, second, and third radiator parts is formed to be rotated about said longitudinal center axes of said helices of said first and second radiator parts.

7. The tunable antenna according to claim 6, wherein said first, second, and third radiator parts are a plurality of first, second, and third radiator parts disposed such that respective longitudinal center axes of said helices of said first and second radiator parts are aligned, said respective longitudinal center axes of said rod and of said third conductor part extend one of parallel and inclined to said longitudinal center axes of said helices of said first and second radiator parts, a conductor part of one of said first, second and third radiator parts electrically contacts an open turn of an adjoining conductor part of one of said first, second and third radiator parts, and at least one of said first, second and third radiator parts is formed to be rotated about said longitudinal center axes of said helices of said first and second radiator parts.

8. The tunable antenna according to claim 1, wherein said couple is a capacitive coupling.

9. The tunable antenna according to claim 1, wherein said electrical coupling is an inductive coupling.

10. The tunable antenna according to claim 1, wherein:

said first and second radiator parts are disposed with respect to one another such that said first and second longitudinal center axes are aligned;

said first and second radiator parts at least one of overlap one another in a direction of said first and second longitudinal center axes and are opposite one another at a predetermined distance; and at least one of said first and second radiator parts is formed to be displaced along said first and second longitudinal center axes such that at least one of an overlap area and said distance between said first and second radiator parts is changed with a degree of displacement.

11. The tunable antenna according to claim 10, wherein said first and second helices have one of identical and different pitches.

12. The tunable antenna according to claim 10, wherein said first and second helices have one of identical and different diameters.

13. The tunable antenna according to claim 10, wherein said first and second helices have one of equal and oppositely directed pitches.

14. The tunable antenna according to claim 1, wherein said at least first and second radiator parts are applied to respective carriers.

15. The tunable antenna according to claim 14, wherein said respective carriers are at least one of round and angular.

16. The tunable antenna according to claim 1, wherein said at least first and second radiator parts are manufactured in MID technology.

17. The tunable antenna according to claim 1, wherein said at least first and second radiator parts are fixed with respect to one another after being set to a desired radiation pattern.

18. The tunable antenna according to claim 1, wherein said first, second, and third radiator parts are fixed with respect to one another after being set to a desired radiation pattern.

19. The tunable antenna according to claim 1, wherein said first and second helices have one of identical and different pitches.

20. The tunable antenna according to claim 1, wherein said first and second helices have one of identical and different diameters.

21. The tunable antenna according to claim 1, wherein said first and second helices have one of equal and oppositely directed pitches.

22. A tunable antenna, comprising:

at least first and second separate radiator parts having a capacitive coupling therebetween and defining a radiation pattern, said coupling formed to be changed by at least one of rotation and displacement of said at least first and second radiator parts with respect to one another where a respective degree of at least one of rotation and displacement creates a corresponding change said radiation pattern;

said first radiator part having a first helix and a first plate part, said first helix having an end and a first longitudinal center axis, said first plate part being disposed at said end and being disposed in a plane extending one of perpendicular and inclined to said longitudinal center axis of said first helix; and said second radiator part having a second helix and a second plate part, said second helix having an end and a second longitudinal center axis, said second plate part being disposed at said end of said second helix and being disposed in a plane extending one of perpendicular and inclined to said second longitudinal center axis.

23. The tunable antenna according to claim 22, wherein said first and second radiator parts are disposed with respect to one another such that said first and second longitudinal center axes are aligned and said first plate part is opposite said second plate part at a predetermined distance, and at least one of said first and second radiator parts is formed to be rotated about said first and second longitudinal center axes such that an area of coverage of said first and second plate parts is changed with a respective degree of rotation.

24. The tunable antenna according to claim 22, in which said first and second plate parts are disc segments.

25. The tunable antenna according to claim 22, wherein said first and second helices have one of identical and different pitches.

26. The tunable antenna according to claim 22, wherein said first and second helices have one of identical and different diameters.

27. The tunable antenna according to claim 22, wherein said first and second helices have one of equal and oppositely directed pitches.

28. A tunable antenna, comprising:

at least first and second separate radiator parts having an inductive coupling therebetween and defining a radiation pattern, said coupling formed to be changed by at least one of rotation and displacement of said at least first and second radiator parts with respect to one another where a respective degree of at least one of rotation and displacement creates a corresponding change said radiation pattern;

said first radiator part having a first helix and a first meander-shaped part, said first helix having a first longitudinal center axis;

said second radiator part having a second helix and a second meander-shaped part, said second helix having a second longitudinal center axis;

said first and second radiator parts being disposed with respect to one another such that said first and second longitudinal center axes are aligned and said first meander-shaped part contacts said second meander-shaped part; and at least one of said first and second radiator parts being formed to be rotated about said first and second longitudinal center axes such that an inductance formed by said first and second meander-shaped parts is changed with a degree of rotation.

29. The tunable antenna according to claim 28, wherein at least one of said first and second meander-shaped parts is a radiating part.

30. The tunable antenna according to claim 28, wherein said first and second helices have one of identical and different pitches.

31. The tunable antenna according to claim 28, wherein said first and second helices have one of identical and different diameters.

32. The tunable antenna according to claim 28, wherein said first and second helices have one of equal and oppositely directed pitches.

* * * * *